United States Patent [19]

Norman

[11] Patent Number: 4,995,534

[45] Date of Patent: Feb. 26, 1991

[54] DETACHABLE VOLVED DISPENSING HEAD FOR BOTTLE

[75] Inventor: Richard O. Norman, San Antonio, Tex.

[73] Assignee: TexPro, Inc., Burnet, Tex.

[21] Appl. No.: 404,173

[22] Filed: Sep. 7, 1989

[51] Int. Cl.[5] ..... B67D 5/60

[52] U.S. Cl. ..... 222/511; 222/394; 222/464; 222/518; 215/5

[58] Field of Search ..... 215/4, 5; 222/464, 511, 222/518, 394, 399, 402.1, 402.25, 559, 484

[56] References Cited

U.S. PATENT DOCUMENTS

| | | | |
|---|---|---|---|
| 327,402 | 9/1885 | Malmstrom et al. . | |
| 361,400 | 4/1887 | de Quillfeldt . | |
| 417,336 | 12/1889 | Radvanyi | 215/5 |
| 504,235 | 8/1893 | Nicole . | |
| 934,819 | 9/1909 | Koscherak . | |
| 938,746 | 11/1909 | Devarco . | |
| 1,064,092 | 6/1913 | Schultz, Jr. | 215/5 |
| 1,977,328 | 10/1934 | Sousley . | |
| 2,037,220 | 4/1936 | Eugster | 215/5 |
| 2,401,391 | 6/1946 | Vale et al. . | |
| 2,547,109 | 4/1951 | Bacheller . | |
| 2,562,111 | 7/1951 | Michel . | |
| 2,678,747 | 5/1954 | Caitung . | |
| 2,682,977 | 7/1954 | Spiess, Jr. et al. . | |
| 2,685,978 | 8/1954 | Crockett | 222/511 |
| 2,830,745 | 4/1958 | Alcart . | |
| 2,835,534 | 5/1958 | Galeazzi . | |
| 2,837,247 | 6/1958 | Stewart et al. . | |
| 3,058,527 | 10/1962 | Dennis et al. | 222/402.25 X |
| 3,324,903 | 6/1967 | Hinz | 222/464 X |
| 3,384,276 | 5/1968 | Henningfield . | |
| 3,458,090 | 7/1969 | Scoggin, Jr. . | |
| 3,863,673 | 2/1975 | Sitton | 222/511 X |
| 3,927,801 | 12/1975 | Martin et al. . | |
| 3,976,221 | 8/1976 | Martin et al. . | |
| 3,998,274 | 12/1976 | Liautaud | 222/464 X |
| 4,194,653 | 3/1980 | Brown . | |
| 4,589,577 | 5/1986 | Welsh et al. . | |
| 4,694,975 | 9/1987 | Hagan | 222/464 X |
| 4,715,516 | 12/1987 | Salvail | 222/518 X |
| 4,732,300 | 3/1988 | Valiyee et al. . | |
| 4,760,940 | 8/1988 | Wallace . | |

FOREIGN PATENT DOCUMENTS

| | | |
|---|---|---|
| 147881 | 11/1936 | Australia . |
| 377152 | 7/1909 | France . |
| 976784 | 3/1951 | France . |
| 620884 | 1/1949 | United Kingdom . |

*Primary Examiner*—Kevin P. Shaver
*Attorney, Agent, or Firm*—Vaden, Eickenroht, Thompson & Boulware

[57] ABSTRACT

A dispensing apparatus for attaching to the bottleneck of a bottle filled with a carbonated drink. The apparatus includes an adapter ring with angled surfaces for sealing onto the bottleneck and a valve housing attached to the adapter ring. The valve housing having a valve closure member that diverges away from sloping walls of an entry chamber to provide a range of control for flow control, and soft contours at every juncture to minimize turbulence.

9 Claims, 2 Drawing Sheets

DETACHABLE VOLVED DISPENSING HEAD FOR BOTTLE

BACKGROUND OF THE INVENTION

1. Field of the Invention

This invention pertains to liquid dispensing apparatus and particularly to such apparatus that can be used for dispensing a carbonated soft drink from a large soft drink bottle.

2. Description of the prior art

A carbonated drink is normally dispensed from its bottle by a person turning the bottle over by hand and pouring a drink therefrom into a glass or a cup or the like. Although satisfactory for small bottles when the entire contents are dispensed on one or two pourings, such dispensing procedure is not always satisfactory from large bottles, such as from a two or three liter bottle. Not only are such bottles, especially full, awkward and heavy, but it is common that the bottle is not drained when dispensing is completed. A bottle not drained, if allowed to sit uncapped for any length of time, will not keep the liquid within it carbonated. Moreover, when many drinks are being dispensed, it is much more efficient to have dispensing apparatus for the bottles, especially if the dispensing apparatus minimizes turbulence and, therefore, minimizes the formation of foam in the liquid as it is being dispensed.

Bottle dispensers have been developed in the prior art; however, heretofore none has been as efficient and simple to manufacture, to clean after use, or to controllably operate as applicant's liquid dispensing apparatus that is described and claimed herein. Representative of the latest in such designs prior to that disclosed herein is shown and described in U.S. Pat. No. 4,194,653, issued March 25, 1980 to Joe L. Brown. The Brown dispenser includes, in one embodiment, an adapter that attaches to the top of a bottle. A so-called sealing ring press fits around the top of a long tube that goes into the bottle and is "sealed" in place by the tightening of the adapter onto the bottle. A valve mechanism is then pressed over the adapter ring. A plunger operated from the top opens a valve chamber in the valve mechanism in on/off fashion to communicate the tube in the bottle through the valve chamber with an external dispensing spout. The flow is caused by the carbonation within the liquid and the flow rate is determined by the ratio of the tube internal diameter to the internal diameter of the spout.

It has been discovered that the parts of the dispenser and adapter do not reliably seal, especially after initial use; the flow is not easy to control and either bursts out or shuts off; the liquid flow is quite turbulent so that bubbles in the liquid produce an excessive "head" on the dispensed liquid; and the many parts are cumbersome to clean and reinstall after use before the apparatus can be used again.

Therefore, it is a feature of the present invention to provide an improved liquid dispensing apparatus for use with a bottle containing carbonated soft drink or the like that has a controllable valving mechanism, the flow rate being determined by how hard a plunger button depressed.

It is another feature of the present invention to provide an improved liquid dispensing apparatus of such type that comprises very few parts and is, therefore, easy to clean prior to reuse.

It is still another feature of the present invention to produce an improved liquid dispensing apparatus that reliably seals against leakage both during usage and between uses to prevent carbonation from escaping.

SUMMARY OF THE INVENTION

The preferred embodiment of the invention is a liquid dispensing apparatus comprising three principal parts: namely, (1) an adapter that positively seals over the top of a soft drink bottle or the like, (2) a tube that passes through a snug central hole in the adapter and reaches down under the surface of the liquid in the bottle, and (3) a valve housing and valve mechanism that latches to the adapter by a quick-disconnect mechanism and securely seals against the adapter and the top of the tube and, in use, provides flow controlled, non-turbulent dispensing.

The adapter effectively seals with respect to the top of the bottle by having an internal threaded cap portion and an internal depending ring portion that are separated by a wedge shaped gap that wedges the adapter onto the bottle as the adapter is tightened.

The valve housing effectively seals with the adapter and the tube since the adapter has an upstanding ring portion spaced apart from the external surface of the tube but angled with respect thereto The valve housing has a downwardly depending ring portion that wedges between the upstanding ring portion of the adapter and the surface of the tube. An elastomeric O-ring located between parts of the valve housing and the adapter provides additional sealing.

The chamber in the valve housing in which the closure end of the plunger operates gradually increases from its valve seat dimension at the top to its incoming opening, which is in communication with the top of the tube. The closure end of the plunger is bulbous shaped with the contour quickly diverging from the walls of the chamber, progressing from top to bottom. Thus, when the plunger is depressed against an upwardly directed biasing spring, the flow path around the bulbous closure end and through the valve seat is controllably, variably larger depending on how hard the plunger is pressed. The rounded contours also minimize the development of turbulence in the flow path.

The channel above the valve seat is larger than the shaft of the plunger that operates within it, the channel communicating with the discharge spout, thereby completing the flow path through the housing.

BRIEF DESCRIPTION OF THE DRAWINGS

So that the manner in which the above-recited feature, advantages and objects of the invention, as well as others which will become apparent, are attained and can be understood in detail, more particular description of the invention briefly summarized above may be had by reference to the embodiments thereof which are illustrated in the drawings, which drawings form a part of this specification. It is to be noted, however, that the appended drawings illustrate only preferred embodiments of the invention and are therefore not to be considered limiting of its scope as the invention may admit to other equally effective embodiments.

IN THE DRAWINGS

Figure 1:
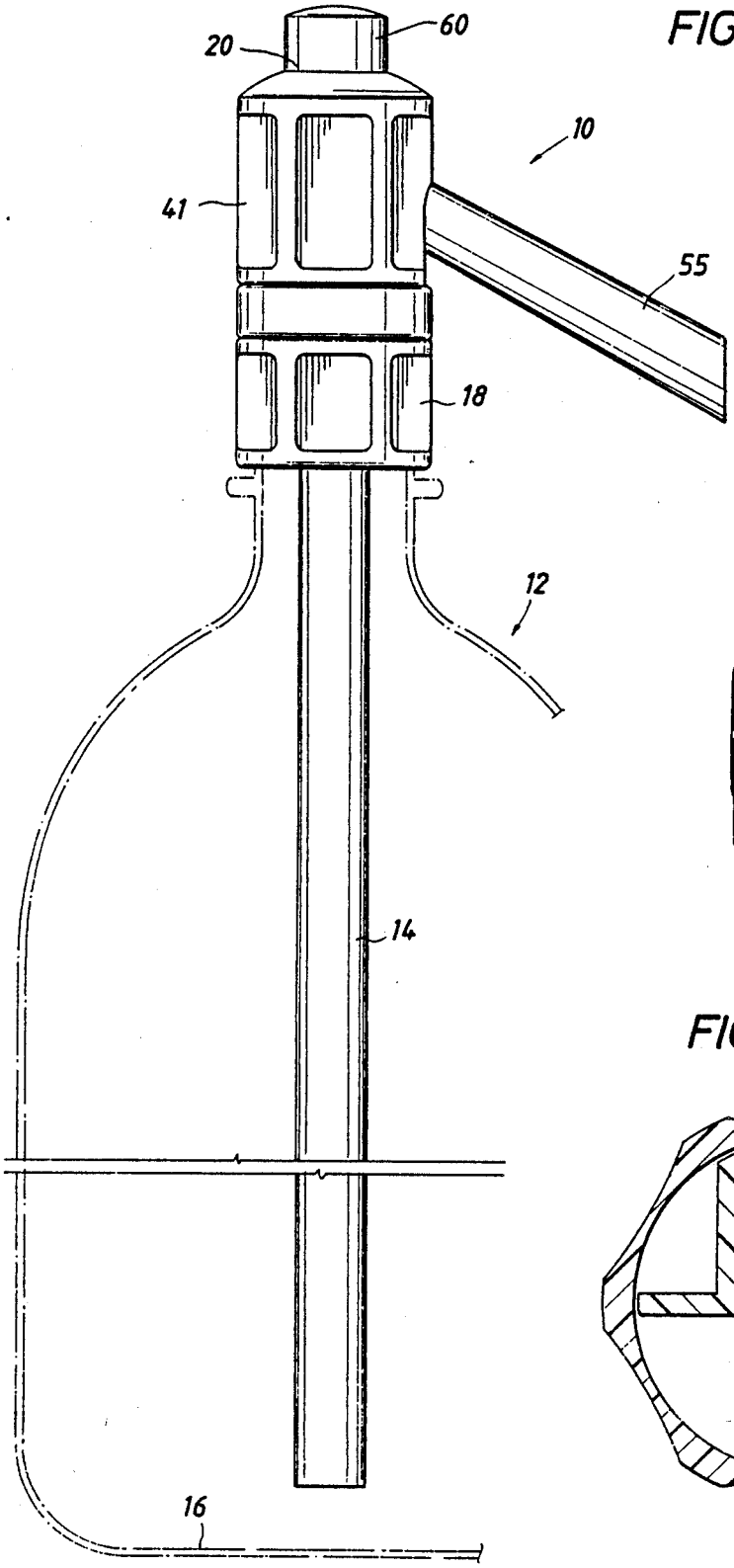

FIG. 1 is a side view of a preferred embodiment of the dispensing apparatus in accordance with the present invention showing the elongated tube thereof inserted into a bottle depicted by dotted lines.

Figure 2:
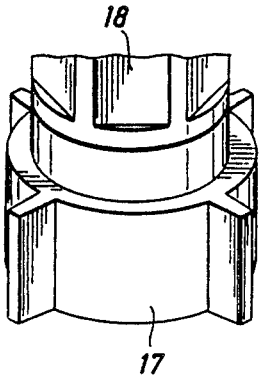

FIG. 2 is a pictorial view of an alternate adapter ring used in conjunction with the dispensing apparatus when attached to a larger bottle, such as a three (3) liter bottle.

Figure 3:
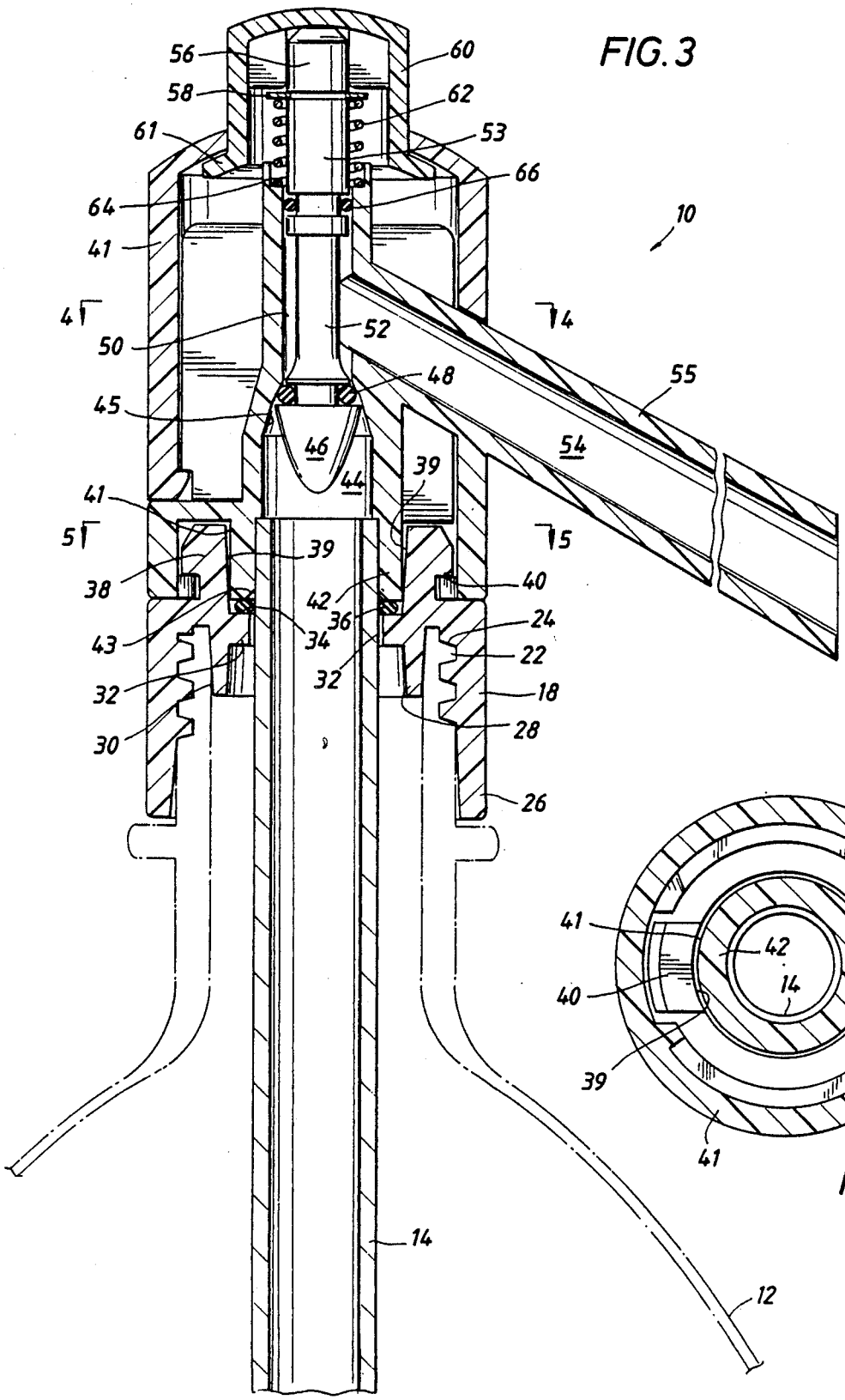

FIG. 3 is a vertical cross-sectional view of the dispensing apparatus shown in FIG. 1.

Figure 4:
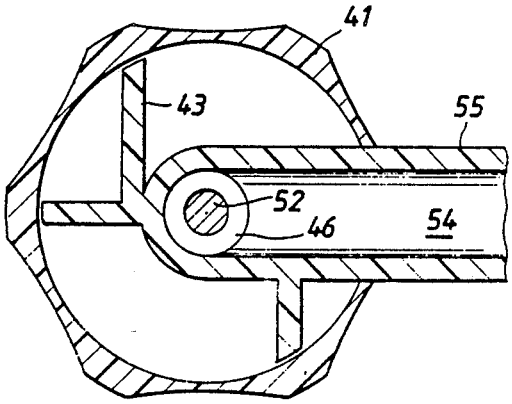

FIG. 4 is a view taken at 4—4 of FIG. 3.

Figure 5:
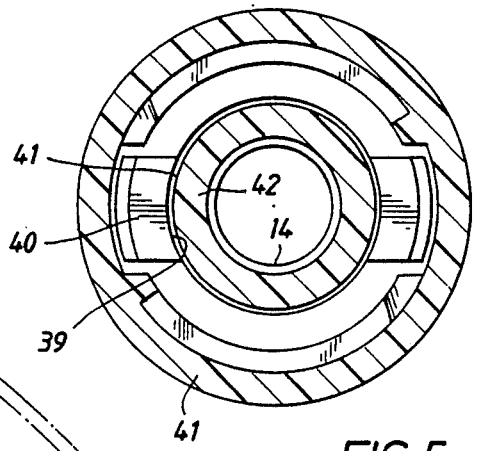

FIG. 5 is a view taken at 5—5 of FIG. 3.

DESCRIPTION OF THE PREFERRED EMBODIMENT

Now referring to the drawings in first FIG. 1, a dispensing apparatus 10 in accordance with a preferred embodiment of the present invention is shown as it is installed on a typical soft drink bottle 12 shown in the partial dotted section. The drink is precharged with carbonated water in typical fashion. The bottle shown can be considered to be a two (2) liter bottle, although this invention is not restricted to the size of the bottle so long as the parts of the dispenser are compatible and fit with the bottle.

The dispensing apparatus generally comprises an elongated tube 14, which conveniently can be of Teflon (TM) or other similar material, that is inserted through the neck of the bottle after the cap is removed. The lower end of tube 14 opens near the bottom surface 16 of the bottle, which is well below the surface of the liquid in the bottle even after some of the liquid has been previously dispensed. The upper section of apparatus 10 is made of PVC or other hard plastic material and includes an adapter ring 18 for attaching the apparatus to the top of the bottle 12 in a manner more completely described hereinafter and a valve 20 that provides the dispensing through its spout. Again, a more complete description of the valve operation is described below.

The adapter ring 18 is also screwed onto bottles having an opening corresponding to the diameter of a three liter bottle by the use of coupler 17 shown in FIG. 2. Coupler 17 is provided on one side with internal threads (not shown) for receiving the threads 22 of adapter ring 18 and, on the other side, a set of threads for mating and sealing with the threads in the discharge opening of such larger bottles.

Now referring to FIG. 3, the innerworkings of apparatus 10 are shown in a cross-sectional view. The upper portion of the bottle 12 to which the apparatus 10 is attached includes outwardly directed screw spreads around its neck over which a cap was attached at the time the bottle was sold. As previously mentioned, this cap has been removed before the dispensing apparatus is installed. Adapter 18 includes internal threads 24 compatible with threads 22 of the bottle. It will be seen that adapter ring 18 has an external depending ring portion 26 below threads 22 and 24 an internal depending ring portion 28 that fits snuggly inside the neck opening of the bottle. The inside diameter surface of ring 28 is spaced apart from tube 14. The outside diameter surface 30 of ring 28, however, comes into sealing contact with the inside neck surface of bottle 12. In order to provide this sealing contact, outside surface 30 of depending ring 28 is angled with respect to the vertical longitudinal axis of bottle 12 so that as adapter ring 18 is screwed down onto the bottle, the top surface of the bottle just above the threads wedges against the ring surface.

Adapter ring 18 includes an inwardly projecting ring portion 32 above and attached to ring 28 through which tube 14 extends. Also, portion 32 provides a top shelf surface 34 for accommodating an elastomeric resilient 0-ring 36. Adapter ring 18 also includes an upstanding projection 38 attached to portion 32 that provides a nearly vertical wall 39 for limiting the outward movement of O-ring 36 and outwardly projecting quick-disconnect dog 40 for quick assembly and disassembly of the valve housing to adapter ring 18 by an accommodating ledge in a manner well known in the art.

Now referring to the valve housing, a lower depending ring 42 thereof descends around the outside surface of tube 14 and inside vertical wall 39 of upstanding portion 38 so as to come into abutting contact with 0-ring 36. The bottom surface of ring 42 may be conveniently beveled so that when O-ring 36 is squeezed with its downward force, the beveled end 43 of ring 42 aids in causing the 0-ring surface to spread and enlarge against the outside surface of tube 14, thereby effecting a larger seal surface between the parts. It is important that a good seal is effected so that the dispensing liquid does not come up around tube 14 and leak out of the dispensing apparatus 10 between the adapter ring 18 and the valve housing.

It should also be noticed that as the valve housing is locked into place on the adapter ring 18, portion 38 of the adapter ring 18 urges the end of ring 42 inwardly to squeeze it against tube 14. The inside surface 41 of ring 38 is slightly conically shaped to assist in this action.

A valve chamber 44 of the housing communicates with the upper end of tube 14 and has inwardly sloping walls 45 that mate with the valve seat portion of closure end 46 of the valve plunger. Closure end 46 is bulbous in contour formation so that its outside surface diverges away from wall 45 of the valve chamber, the valve seat contact surface preferably is a replaceable resilient grommet 48 located within an accommodating notched annular groove.

Chamber 50 above valve closure 46 is larger in internal diameter than the external diameter of shaft 52 of the valve plunger that operates within the chamber 50. Shaft 52 is attached at its lower end to closure end 46 and at its upper end to handle 53 of the plunger. Thus, it will be seen that when the plunger is depressed it allows fluid to flow upwardly around the closure end 46 and to enter chamber 50. A spout tube 54 located within spout housing 55 is in open communications with chamber 50 so that the dispensed fluid moves with ease at this point.

Upper end 56 of the valve plunger attached to handle 53 has a receiving ring groove for receiving a snap ring 58, and button cap 60 is provided with a flange 61 to secure button cap 60 to shell 41 and insure contact with the upper end of plunger 56. A biasing spring 62 surrounding handle 53 of the plunger is captured below snap ring 58 and a shoulder 64 presented by the valve housing for limiting the downward movement of spring 62. An 0-ring 66 located in an appropriate groove above shaft 52 prevents liquid from getting into the spring portion of the valve. It should be noted that spring 62 biases the plunger in its upward position to close the valve seat until the spring 62 is overcome by downward pressure on button cap 60 by the operator.

In the dispensing operation, a downward pressure on button cap 60 causes closure lower end 46 to move downwardly and thereby provides a small opening around the closure end 46 for the dispensing of liquid in the bottle 12. Since the fluid in the bottle 12 is carbonated, it effervesses and the liquid flows up tube 14 through the valve opening into chamber 50 and from chamber 50 out tube 54, as desired. That is, as more downward pressure is applied on button cap 60, lower closure end 46 is moved further and further down, thereby providing a larger and ever-increasing opening around the valve closure. This ever-increasing opening is the result of interaction between the surface of the bulbous closure end and the slanted walls 44 of chamber 43, which diverge to provide such opening operation. This control is a vast improvement over sudden opening or sudden closing dispensers in the prior art. The smooth surface of the valve closure, particularly of the vicinity of valve seat grommet 48, provides a even flow for the liquid and minimizes the amount of turbulence that might otherwise be present.

The valve housing is conveniently made up of a shell 41 of any pleasing shape desired and a spider 43, as shown in FIG. 4, for lightness separately fabricated and fused together by spot heating.

The adapter ring can either have several flat surfaces such as shown in FIG. 1 to permit the ring to be easily gripped, can be knurled or can have several outwardly directed keys 45. This latter design is useful for a bigger overall structure such as might be used on 3-liter bottles. The keys allow the operator to have more leverage in turning. It should be further noted that the adapter ring of the dispensing apparatus is attachable to either a glass or a plastic bottle.

Although a particular embodiment of the invention has been shown and described, with an alternate adapter ring also shown and described, it will be understood that the invention is not limited thereto, since many modifications can be made and will become apparent to those skilled in the art.

What is claimed is:

1. Liquid dispensing apparatus for controllably dispensing pressurized liquid from a container, a discharge opening therefrom being located above the surface of the liquid contained within the container, comprising an adapter for matingly sealably connecting with the discharge opening of the container, said adapter including a central opening, an elongate tube insertable through said central opening of said adapter such that the lower end thereof is within the liquid, an elastomeric resilient 0-ring sealing against the outside surface of said tube near its upper end, said adapter including a shoulder for limiting the downward location of said O-ring, a dispensing valve housing seatably connectable to the top of said adapter and surrounding the top of said tube, said housing having a valve chamber contiguous with the top opening of said tube, the walls of said chamber gradually reducing in dimension to form a valve seat at the upper end of said chamber, said housing having a channel above said valve seat, an elongate valve plunger having a bulbous lower closure end operably located within said chamber and with an external surface that diverges below said valve seat from the adjacent wall of said chamber, said closure end having a contact seating surface above its maximum diameter dimension, said plunger having an elongate plunger shaft operating within said channel and connected to said bulbous lower end, said shaft being smaller in diameter than said channel, bias means connected to said plunger for urging the plunger upward to close its closure end in said valve seat, and a dispensing spout having an input opening into said channel, wherein downward pressure applied to said valve plunger overcoming said bias means causes the downward descent of said bulbous closure end into said chamber to provide an increasingly larger flow path between said walls of said chamber and said closure end for liquid drawn from the container depending on the increasingly downward position of said valve plunger.

2. Liquid dispensing apparatus in accordance with claim 1, wherein the container is a bottle and the discharge opening is through its bottleneck, and said adapter includes an internally threaded cap portion for matingly threading with the external threads in said bottleneck, and said adapter includes a depending portion for inserting into the opening through the bottleneck and forms a tapered gap with said cap portion, the smallest dimension of the gap being at the top of the gap so as to sealingly wedge the adapter onto the top of the bottleneck as said adapter is tightened in place thereon.

3. Liquid dispensing apparatus in accordance with claim 1, wherein the inside surface of said central opening press fits against the outside surface of said tube.

4. Liquid dispensing apparatus in accordance with claim 1, wherein said valve housing includes a depending ring below said valve chamber that press fits over the top of said tube and abuts the top of said O-ring.

5. Liquid dispensing apparatus in accordance with claim 4, wherein said adapter includes an upstanding ring attached to said shoulder that press fits against the outside surface of said depending ring on said valve housing.

6. Liquid dispensing apparatus in accordance with claim 5, wherein the internal surface of said adapter ring is slightly angled with respect to the outside surface of said tube so that as the valve housing is lowered onto said adapter, said adapter ring inwardly biases said housing valve ring to grippingly seal against said tube.

7. Liquid dispensing apparatus in accordance with claim 6, wherein said valve housing has a second depending ring outside of said first-named ring, said second depending ring including an internal latching means, and said adapter ring includes an external latching means for latching with said internal latching means on said second depending ring.

8. Liquid dispensing apparatus in accordance with claim 7, wherein said internal latching means includes a receiving groove and said external latching means is a dog mateable with said groove in said internal latching means.

9. Liquid dispensing apparatus in accordance with claim 1, wherein said bulbous closure end is grooved at said contact seating surface, and including a replaceable seal fitting within said seating surface groove having a smooth, continuous outer surface with the surface of said bulbous closure end.

* * * * *